United States Patent [19]

Molat

[11] Patent Number: 4,500,877

[45] Date of Patent: Feb. 19, 1985

[54] CHANGEABLE CIRCUIT CONTROLLING SWITCH ASSEMBLY

[76] Inventor: Joseph H. Molat, Stratford 36C, West Palm Beach, Fla. 33409

[21] Appl. No.: 464,976

[22] Filed: Feb. 8, 1983

Related U.S. Application Data

[62] Division of Ser. No. 165,227, Jul. 1, 1980, Pat. No. 4,384,720.

[51] Int. Cl.[3] ..... G09F 9/30; H01H 17/14

[52] U.S. Cl. ..... 340/711; 200/153 LA; 200/6 R; 200/286

[58] Field of Search ..... 273/237; 200/161, 61.1, 200/153 LA, 6 R, 286; 340/711, 763, 783, 815.23, 815.29

[56] References Cited

U.S. PATENT DOCUMENTS

| | | | |
|---|---|---|---|
| 756,049 | 3/1904 | Pitel | 200/161 |
| 4,197,437 | 4/1980 | Michalski | 200/67 D |
| 4,228,596 | 10/1980 | Daniel | 273/237 X |
| 4,394,546 | 7/1983 | Harumatsu | 273/DIG. 28 |

*Primary Examiner*—Paul E. Shapiro
*Assistant Examiner*—Scott L. Brown
*Attorney, Agent, or Firm*—Harvey B. Jacobson

[57] ABSTRACT

A switch assembly controls a plurality of circuits through contact carrying walls of a switch housing disposed in angular relation to each other about a guide post slidably mounting actuator elements that are displaceable to pivot contactors into engagement with the contact carrying walls. The housing depends from a support panel through which the actuator elements are manually manipulated.

5 Claims, 9 Drawing Figures

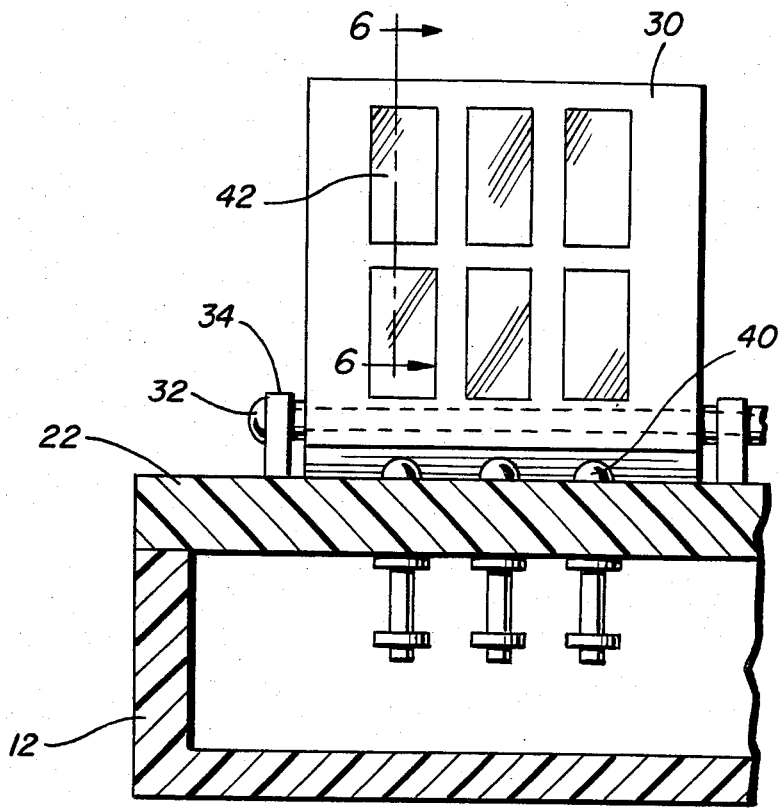
Fig. 5
Fig. 6
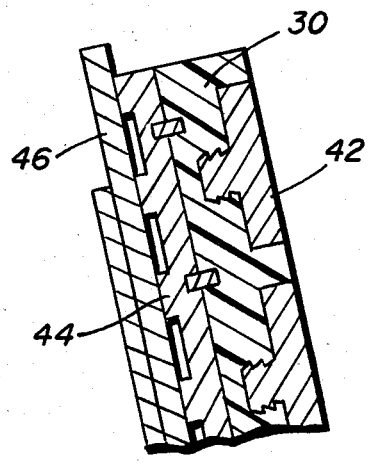
Fig. 7
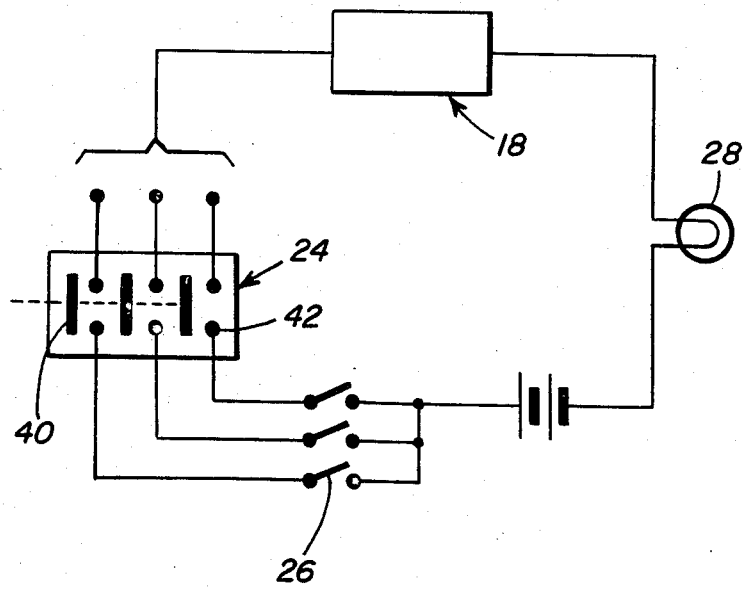

CHANGEABLE CIRCUIT CONTROLLING SWITCH ASSEMBLY

This application is a division of prior application Ser. No. 165,277 filed July 1, 1980 now U.S. Pat. No. 4,384,720.

BACKGROUND OF THE INVENTION

This invention relates to programmed switch assemblies adaptable for use with game boards as well as for other uses, such as educational and security devices. Insofar as its recreational adaptations are concerned, the present application is an improvement over the game board device disclosed in my prior copending application, Ser. No. 958,360, filed Nov. 3, 1978, now U.S. Pat. No. 4,222,571.

According to the disclosure in my prior patent game board of the "Bingo" card type is provided wherein the board display panel is divided into a plurality of rectangular zones within which manually operable switches are mounted adjacent windows through which changeable zone identifying indicia are exposed. Groups of switches when actuated by a player in certain patterns establish conductive paths through a programmed circuit to energize an indicator signifying a winning game. Such a game board arrangement enables the playing of the game by sight handicapped persons through the manipulation of the manually operable switches on zones identified by indicia capable of being sensed through touch. The foregoing type of game board furthermore provides heightened interest to sighted players as well.

An important object is to provide a programmed control board assembly that is easier to reset and change its program.

A further object is to provide a programmable switch assembly that is easy to operate, economical to manufacture, and adaptable for many uses.

SUMMARY OF THE INVENTION

In its broadest aspect, the present invention resides in a control board that may be programmed for playing games such as "Bingo" by sight handicapped players or programmed for educational and instructive purposes, or for security purposes, such as automotive ignition and security lock operations. The control board includes a panel surface divided into a plurality of zones respectively occupied by manually operable switches. According to one embodiment, a multiple circuit switch assembly is associated with each zone so that the player may register selection of the zone with respect to as many as four different circuits. Several games may thereby be played at one time and the space requirement for each switch is reduced.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
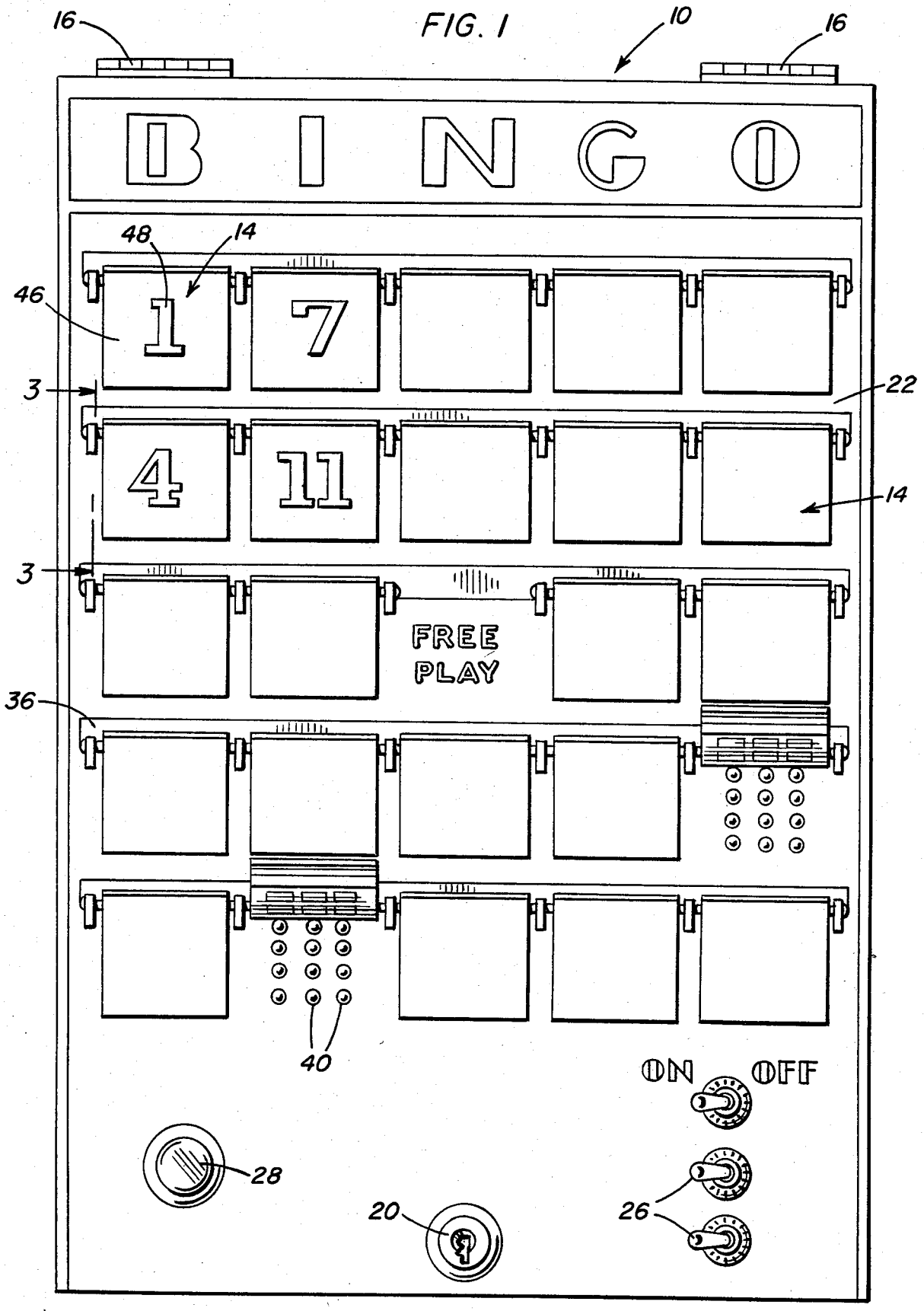
FIG. 1 is a partial section view of a control board showing a multiple circuit switch assembly in accordance with the invention.
Figure 2:
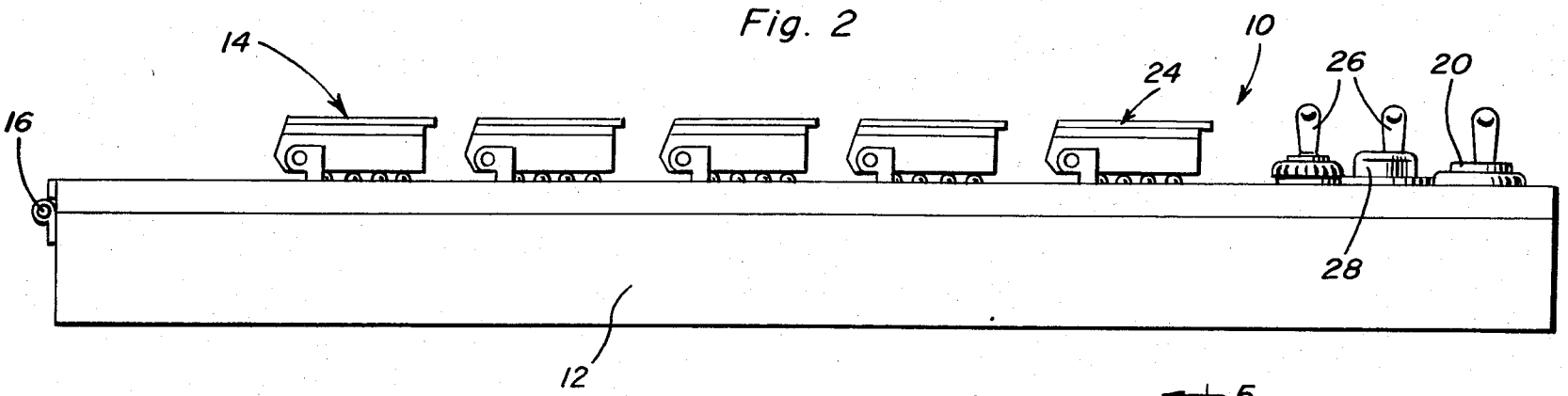
FIG. 2 is a section view taken substantially through a plane indicated by section line 2—2 in FIG. 1.
Figure 4:
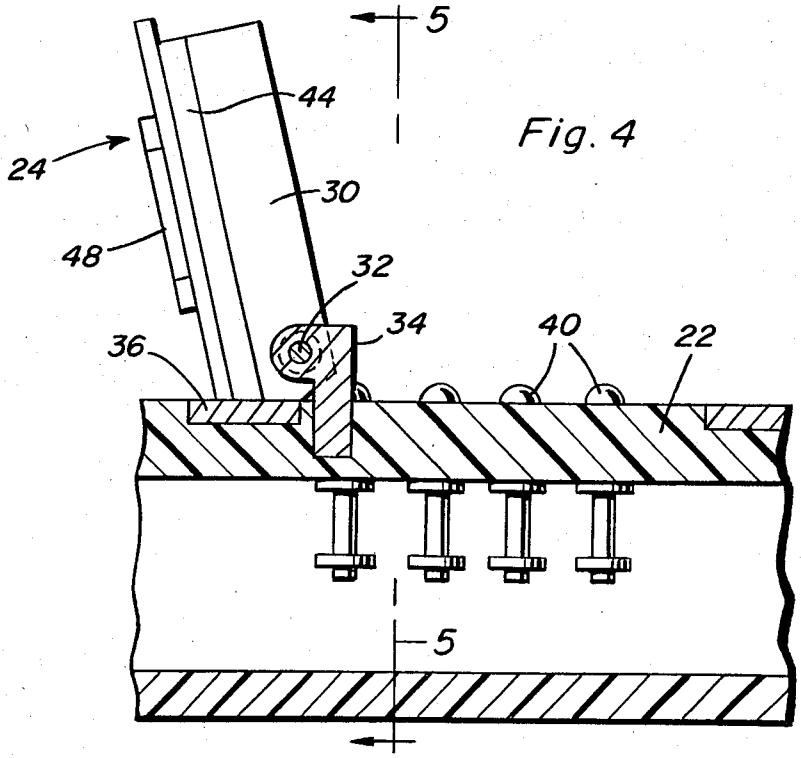
Figure 3:
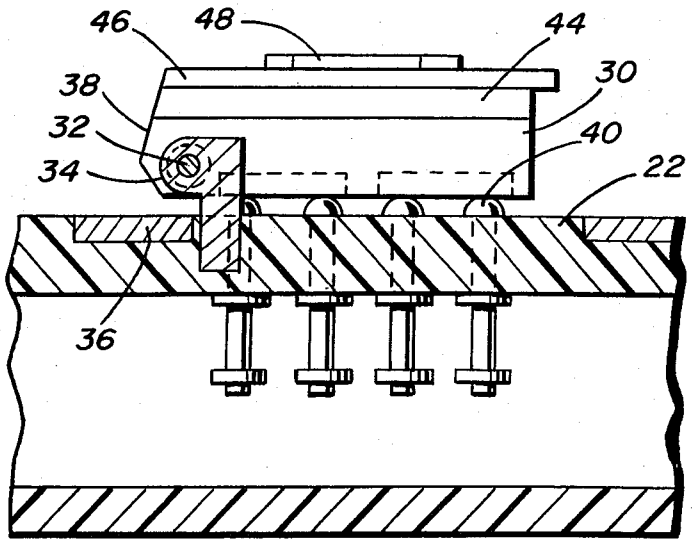

Referring now to the drawings in detail, FIGS. 1 and 2 illustrate a game board embodiment of the present invention generally referred to by reference numeral 52. The game board is divided into a plurality of rectangular zones on its panel surface and a manually operable switch assembly 50 is associated with each of such zones.

Figure 9:
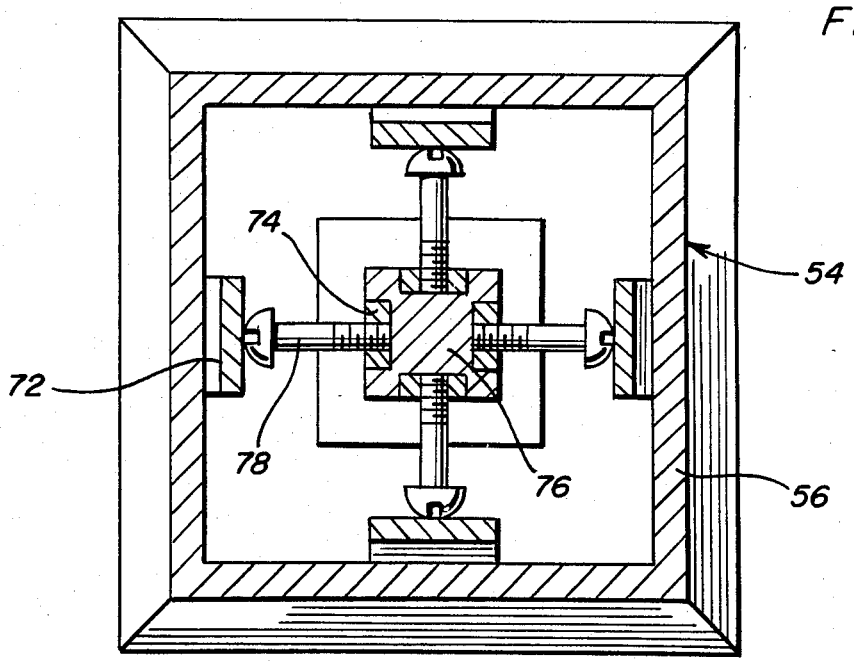

Referring now to FIGS. 9 and 10, a modified form of control board is shown wherein each of the display panel zones has associated therewith a switch assembly generally referred to by reference numeral 50, mounted in underlying relation to the display panel 52 of the control board. As will become apparent, the area of the zone with which the switch assembly 50 is associated, may be smaller than the zones associated with the manually operated switches 14 hereinbefore described with respect to FIGS. 1 through The switch assembly 50 is completely replaceable and readily disassembled from the display panel 52. As much as four different programmed circuits may be controlled by each of the switch assemblies 50, thereby enabling a player to change game patterns and play as much as four different games at the same time in a more efficient and rapid manner than was heretofore thought possible.

Each of the switch assemblies 50 includes a switch housing generally referred to by reference numeral 54 having four inclined, contact mounting walls 56 interconnected with a bottom wall 58 and a top wall 60. The switch housing is removably secured in underlying relation to the display panel 52 means of a threaded cap 62 interconnected with the housing by means of a threaded guide element 64. Lock nuts 66 and 68 hold the housing adjustably assembled on the guide element as more clearly seen in FIG. 8.

Figure 8:
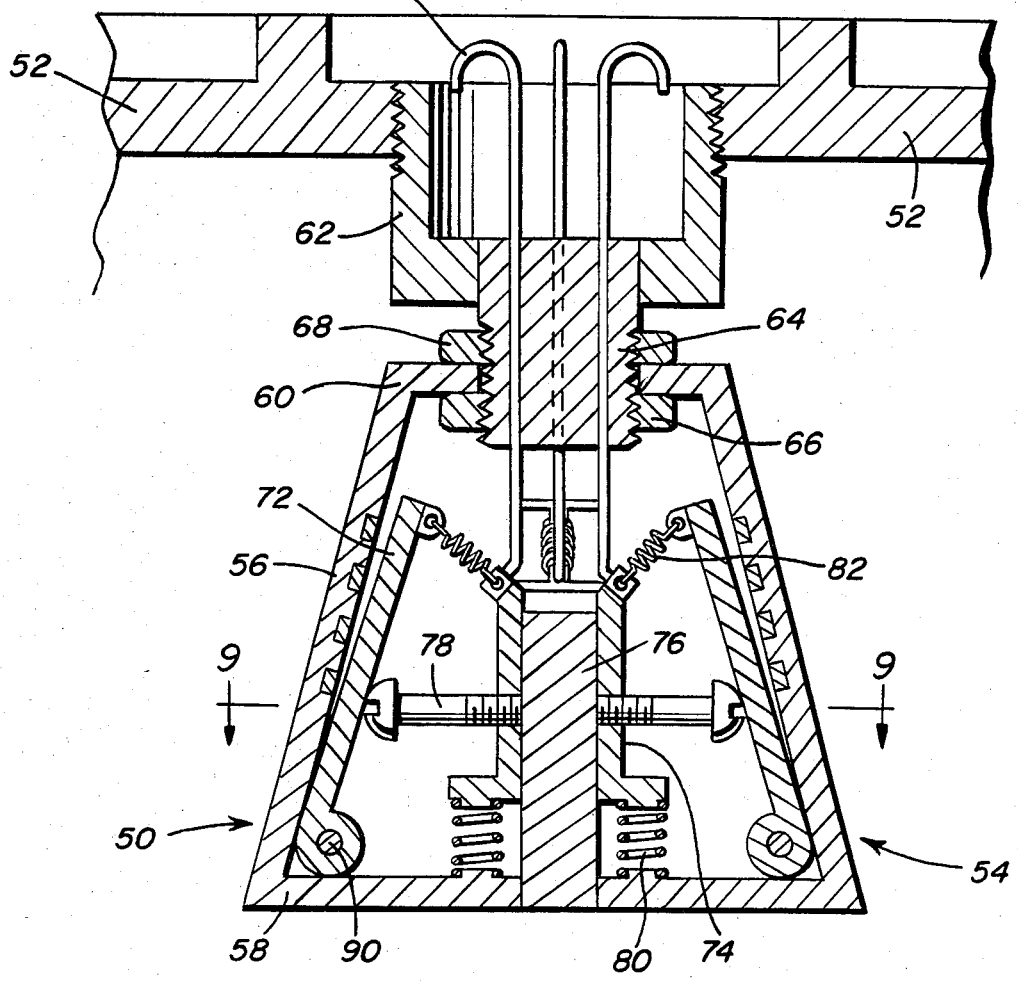

Pivotally mounted by means of a hinge pin 90 adjacent each of the contact mounting walls 56, is a contact element 72 adapted to be yieldably held in an open or inactive position as shown in FIG. 8. Thus, each of the four contact elements 72 when displaced to an active position engaging its associated contact mounting wall 56, will control a separate programmed circuit.

Each of the contact elements 72 is displaced between its operative positions by means of a vertically slidable element 74 slidably mounted on a guide post 76 that may be fixed within the housing. An adjustable screw arm 78 projects laterally from each vertically slidable element 74 into engagement with an associated contact element 72. Each of the vertically slidable elements 74 is yieldably biased to its lower position as shown by a spring element 80. A spring element 82 interconnects the upper ends of each of the vertically slidable elements 74 with its associated contact element 72 in order to yieldably hold the contact element in its open or inactive position as shown. An actuator rod element 84 is connected to the upper end of each vertical slidable element 74 and extends through the guide element 64 for exposure above the display panel 52 within an area smaller than the contact area on wall 56. It will be apparent that when actuated by an upward pull on rod element 84, an associated contact element 72 will be frictionally held in contact with a wall 56 by the wedging action of an arm 78. A downward push on an actuated rod element 84 releases the contact element 72 for displacement to the inactive position under the bias of springs 82 and 80. Thus, the player may actuate any one or a combination of four contact elements 72 in order to register selection of a zone through one or more programmed circuits. It will thereby be apparent that the player may not only register a selected zone, but may also change the selected pattern that is signified by operation of the indicator associated with the control board.

The foregoing is considered an illustrative only of the principles of the invention. Further, since numerous modification and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a control board assembly, a display panel divided into a plurality of zones, manually operable means displaceable between inactive and active positions at each of said zones for registration of selected ones of the zones, indicator means operatively connected to the manually operable means for signifying registration of a group of the zones in a predetermined pattern, means cooperating with the manually operable means for holding thereof in the inactive position at each of said zones, and changeable means associated with the holding means and the manually operable means at each of the zones for changing the predetermined pattern signified by the indicator means, said manually operable means including a switch housing mounted in underlying relation to said display panel having a contact mounting wall depending from the panel in angular relation thereto, a pivoted contact element biased to the inactive position, slidable means mounted within the switch housing and engageable with the contact element for displacement thereof toward the contact mounting wall from the inactive position, actuator means connected to the slidable means for displacement thereof, and guide means through which the actuator means extends for exposing the actuator means above the display panel, additional contact mounting walls, and associated contact elements, and a plurality of actuator rods associated with said actuator means.

2. The combination of claim 1 wherein said support is a control board having a display panel divided into a plurality of zones, and a manually operable switch assembly associated with each of said zones and one of the actuator means, each of said contact mounting walls having a contact area smaller than that of the associated zone on the display panel, each of said actuator means being exposed on the display panel within the zone associated with the associated manually operable switch assembly.

3. In a switch assembly including a housing, actuator means displaceable along a predetermined path relative to the housing for controlling a plurality of circuits, guide means connected to the housing for establishing said predetermined path, contact means mounted in the housing in angular relation to said path, a plurality of movable contact elements displaceable from inactive positions into engagement with said contact means, and means operatively connecting the contact elements to the actuator means for displacement from the inactive positions toward the contact means, the actuator means including a plurality of slides mounted in the guide means, and adjustable elements projecting from the slides transverse to said path into engagement with the contact elements, said contact elements being pivotally mounted in the housing.

4. In a switch assembly including a housing and actuator means displaceable along a predetermined path relative to the housing for controlling a plurality of circuits, the improvement comprising a plurality of contact mounting walls fixed to the housing in angular relation to said path, a plurality of movable contact elements displaceable from inactive positions into engagement with said contact mounting walls, respectively, means operatively connecting the contact elements to the actuator means for displacement from the inaction position toward the respective contact mounting walls, and guide means mounted in the housing for guiding movement of the actuator means along said predetermined path, said actuator means including a plurality of slides mounted in the guide means, and adjustable elements projecting from the slides transverse to said path into engagement with the contact elements, said contact elements being pivotally mounted in the housing.

5. The improvement as defined in claim 4 wherein said contact mounting walls are planar sides of the housing interconnected to form an enclosure, said housing having a base connected to said sides.

* * * * *